US007097746B1

(12) United States Patent
Tziviskos et al.

(10) Patent No.: US 7,097,746 B1
(45) Date of Patent: Aug. 29, 2006

(54) ANODIC PROTECTION OF ELECTRICAL CONTACTS

(75) Inventors: George Tziviskos, Encino, CA (US); C. Geoffrey E Fernald, La Canada, CA (US)

(73) Assignee: Advanced Bionics Corporation, Valencia, CA (US)

( * ) Notice: Subject to any disclaimer, the term of this patent is extended or adjusted under 35 U.S.C. 154(b) by 615 days.

(21) Appl. No.: 10/301,026

(22) Filed: Nov. 20, 2002

(51) Int. Cl.
*C23F 13/00* (2006.01)

(52) U.S. Cl. ..... 204/196.23; 204/196.24; 204/196.25; 205/730; 205/731; 205/732; 205/733; 381/330; 381/322; 381/323; 381/324

(58) Field of Classification Search ..... 204/196.23, 204/196.24, 196.25; 205/730, 731, 732, 205/733; 381/330, 322, 323, 324
See application file for complete search history.

(56) References Cited

U.S. PATENT DOCUMENTS 5,260,146 A * 11/1993 Savovic et al. ..... 429/65
6,019,877 A 2/2000 Dupelle et al.
6,703,272 B1 3/2004 Taylor et al.

* cited by examiner

*Primary Examiner*—Bruce F. Bell
(74) *Attorney, Agent, or Firm*—Bryant R. Gold; Victoria A. Poissant; Philip H. Lee

(57) ABSTRACT

An anode protection device and method are provided. The method includes placing a sacrificial anode in proximity to the positive and negative contacts to shield or distort the field therebetween which provides preferential corrosion of the sacrificial anode, instead of the anode. The protection device is a sacrificial anode having various forms and placed in different configurations. In one form the sacrificial anode is a plate. In another form the sacrificial anode is a ring placed around either the positive contact or negative contact to provide a shield between the negative and positive contacts. In a further device embodiment, the sacrificial anodic plate can be welded to the aluminum case of a rechargeable battery of a behind-the-ear (BTE) hearing device.

33 Claims, 3 Drawing Sheets

ANODIC PROTECTION OF ELECTRICAL CONTACTS

BACKGROUND OF THE INVENTION

The present invention relates to methods and devices for preventing or reducing a voltage-induced corrosion of a positive (anodic) contact. In particular the invention is related to anodic protection when both positive and negative contacts are immersed in a conductive solution.

Electrical devices often have positive and negative contacts or connectors to enable one device or component to be electrically connected to another device or component. When the negative and positive contacts are immersed in a conductive fluid, such as perspiration, a parallel circuit can be created between the negative and positive contacts which, over time, can cause anodic material to corrode and dissolve into the conductive solution and form a deposit over the negative (cathodic) contact.

One such instance where anodic corrosion can occur is with multi-component hearing devices, such as a behind-the-ear (BTE) hearing aid or a BTE component of a cochlear implant. A partially implantable cochlear implant system can have both an external BTE component and an implanted component. To overcome sensorineural deafness, numerous implantable cochlear stimulation (ICS) systems have been developed which bypass the hair cells in the cochlea and directly stimulate the auditory nerve fibers in order to induce the perception of sounds in the affected individual. The use of a cochlear implant to restore hearing to the profoundly deaf is now a well-accepted medical procedure.

BTE hearing aids and cochlear implants typically consist of two or more component parts which may be detachable. For example, one component of the BTE device can contain a battery. A second component of the BTE device can have processing circuitry for converting sound waves into electrical signals. The second component can have an integral or a separate, detachable earhook which permits the fully assembled external BTE device to hang over and behind the ear. The first component which contains the battery and the second, main component of the BTE can be electrically connected using positive and negative electrical contacts.

In the presence of a conductive fluid such as perspiration, a parallel circuit is created between the positive and negative contacts via the conductive fluid. In general, the parallel current flowing between the two contacts is very small and, in most instances, the intended electrical connection between the two components remains viable. Yet, over time, this parallel, parasitic flow of current can result in voltage-induced erosion, from corrosion of the positive contact (anode). The rate of erosion typically increases as the voltage potential between the anode and cathode is increased.

There are several known methods for preventing or reducing corrosion of an anodic material. The first method employs a passive anodic protection by placing a more anodic material close to a metal which is to be protected. A second method is anodic protection that is achieved by using a power supply to reverse the effects of galvanic corrosion. Neither method, however, provides adequate protection from voltage-induced erosion in the specific medical device applications described.

What is thus needed is a more effective device or method for preventing erosion of a positive (anodic) contact between external device components such as a multi-component BTE under DC bias.

SUMMARY OF THE INVENTION

The present invention addresses the above and other needs by providing a method and device for reducing voltage-induced erosion.

In one aspect of the present invention, an anodic protection device is provided which disrupts the electrical field between the positive and negative contacts. The device is a sacrificial anode that can be placed in close proximity to either the positive or negative contact to shape the current field and to preferentially corrode the sacrificial anode, instead of the positive contact. The electrical (voltage) potential of the sacrificial anode may be less than, equal to, or greater than the voltage potential of the positive contact. The voltage potential at the sacrificial anode may be derived from the same power source which provides voltage potential to the positive contact or may be derived from a different power source.

The sacrificial anode can be made of aluminum or other materials such as magnesium, zinc, or nickel. When used in conjunction with gold-plated positive and negative contacts, the presence of the sacrificial anode can produce an electrochemical potential difference of at least about 3.0 volts which can protect the positive contact. Given a constant electrochemical potential, the degree of corrosion protection increases as the electrochemical potential increases.

In one embodiment of the device of the present invention, the sacrificial anode can be in the form of a plate that may be placed between the positive and cathode contacts.

In another embodiment of the device of the present invention, the sacrificial anode can be in the form of a cylindrical ring that is used to completely encircle the anode contact, thereby circumscribing the anode electrical field.

In a further embodiment of the device of the present invention, an aluminum anodic plate can be electrically connected (e.g., welded) to the aluminum housing of a battery. The aluminum housing can be set at the same voltage potential as the anode. The battery may be a primary (one-time-only-use) battery or a rechargeable battery such as a lithium-ion battery.

In yet another embodiment of the device of the present invention, the first and second components are electrically connected by positive and negative contacts. The first and second components are detachable and are mechanically connected to form a complete BTE hearing device or the BTE part of a partially implantable cochlear stimulator. The first component may contain a battery and the second component can contain processing circuitry.

In another aspect of the invention, a method of preventing galvanic anode corrosion is disclosed, the method comprising: providing a sacrificial anode having a positive voltage potential and strategically positioning the sacrificial anode to distort the electrical field between the negative and positive contacts to thereby reduce the incidence of anode corrosion.

It is a feature of the present invention that when a sacrificial anode is placed on a discardable component, this component may be thrown away after the sacrificial anode becomes eroded or worn. In particular, the sacrificial anode may be placed directly on a battery housing. When the primary or rechargeable battery becomes worn, the sacrificial anode can be advantageously thrown out at the same time. Subsequently, a new component having a new sacrificial anode and fresh battery can be attached to the main component. Thus, the sacrificial anode protection is periodically renewable.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

The present invention may be applied to any instance where a component or device has positive and negative contacts or connectors that are used to connect to another component or device and the contacts become immersed in a conductive solution that forms a parallel electrical circuit or shunt. Over time, the anode contact may become eroded, which can mechanically weaken the connection, and in some cases lead to a complete break in the connection. The present invention provides a device and method for protecting the anode.

The device of the present invention is a sacrificial anode that is configured and strategically placed in proximity to the positive or negative contact. The sacrificial anode is placed to distort the electrical field gradient between the positive and negative contacts so that current flows preferentially between the sacrificial anode and cathode, instead of between the anode and cathode. This results in the preferential corrosion of the sacrificial anode, rather than the positive contact (anode). Various embodiments of the sacrificial anode are disclosed below.

Figure 1:
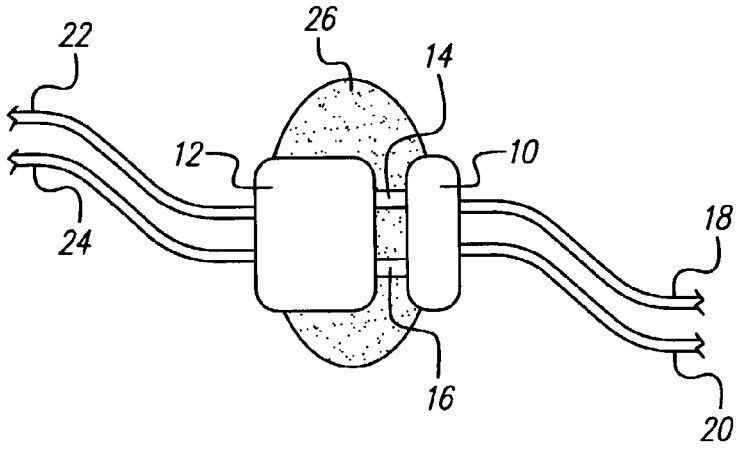
FIG. 1 shows a generalized diagram of a two-component, electrically connected system wherein a first component and a second component are connected therebetween by negative and positive contacts or connectors.

FIG. 1 shows a generalized, exemplary embodiment of a first component (or device) 12 having an positive (anode) contact 14 and a negative (cathode) contact 16. The device 12 may be coupled to insulated conductors or leads 22 and 24 which can be either input or output leads. A second component (or device) 10 is electrically connected to first component 12 through anode contact 14 and cathode contact 16. The second component 10 may optionally have extension leads 18 and 20 which can be connected to anodic and cathodic electrodes (not shown). The anode contact 14 and cathode contact 16 are shown immersed in a conductive solution 26 and therefore an electrical shunt can occur between contact 14 and contact 16. The physical gap between devices 12 and 10 has been exaggerated to better illustrate contacts 14 and 16. In practice, the first and second components, 12 and 10 respectively, may often be substantially in contact with each other, leaving only a very small gap.

The components 12 and 10 can represent a number of different devices. For example, both 12 and 10 may be connectors. In that case, leads 18, 20, 22 and 24 can be extension leads. In yet another case, first component 12 may be an external BTE component containing a primary or rechargeable battery and the second component 10 may contain the BTE processor. In each of these examples, a conductive solution such as perspiration or other conductive fluid immerses the anode and cathode contacts.

Figure 2A:
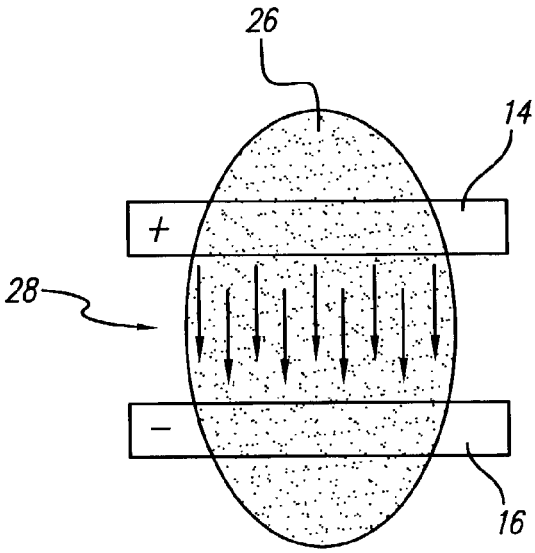
FIG. 2A shows a representation of an electrical field gradient between positive and negative contacts that are immersed in a conductive solution such as perspiration.

FIG. 2A shows an electrical field gradient 28, as indicated by the arrows, produced between the cathode 16 and anode 14 as shown in FIG. 1. The parallel shunt between the cathode and anode contacts presents a common case for occurrence of galvanic corrosion.

Figure 2B:
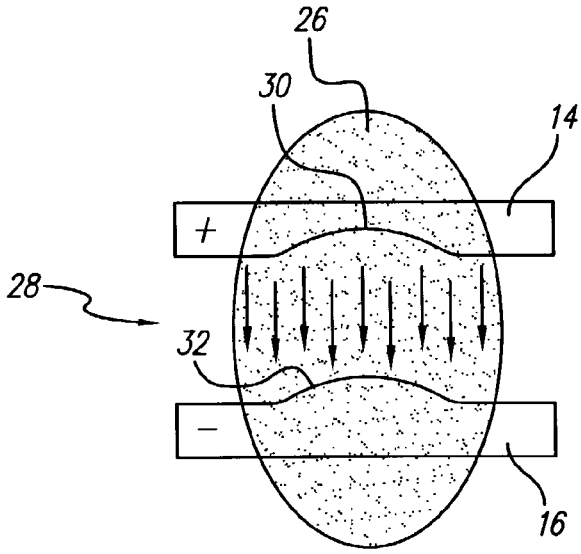
FIG. 2B depicts the effect over time of galvanic corrosion of the positive contact wherein the anode loses material and the cathode gains an ionic deposit.

FIG. 2B shows another view of the galvanic corrosion process of FIG. 2A where, after some time, the anode 14 has eroded at area 30. Conversely, cathode 16 has gained a surface deposit 32. Over time, the anode erosion can physically weaken the contact 14, possibly leading to a complete disconnect.

Figure 3:
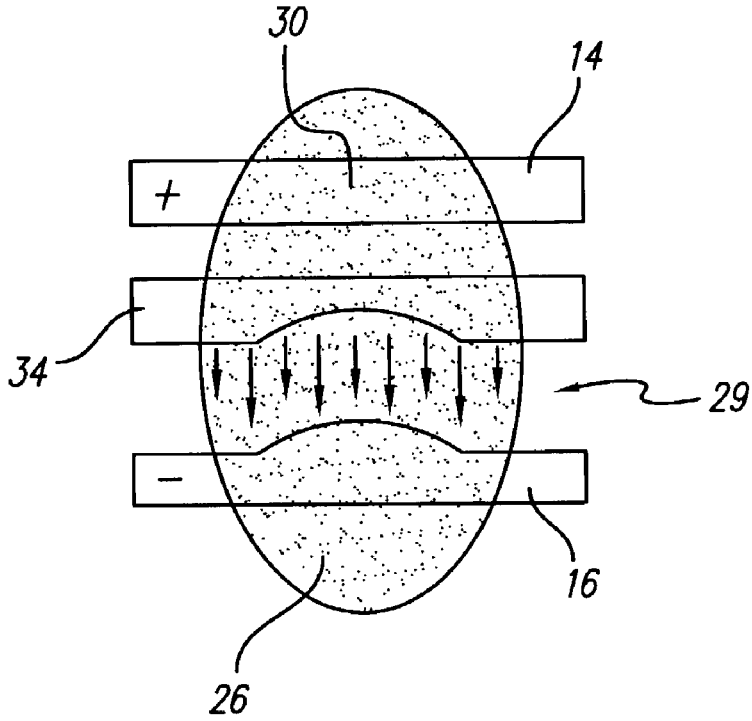
FIG. 3 shows, in accordance with the present invention, the field displacing or shielding effect of placing a sacrificial anode between the positive and negative contacts.

FIG. 3 shows a representation of the device, in accordance with the present invention, wherein a sacrificial, anodic plate 34 is placed in proximity to the anode 14 and cathode 16, which anodic plate placement provides a protective field. The field gradient 29 occurring between the anodic plate 34 and the cathode 16 predominates over the field between the cathode 16 and anode 14. FIG. 3 shows that the anodic plate 34 can act as a sacrificial anode (where most of the corrosion occurs) by distorting the electrical field to protect the anode 14 from corrosion.

Figure 4:
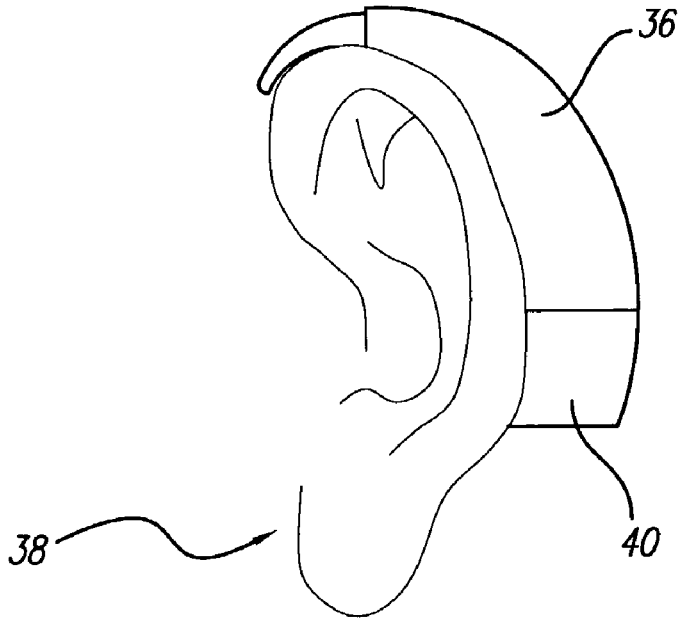
FIG. 4 shows an exemplary BTE hearing device comprised of at least a first and second components, where the first component (bottom detachable part) contains either a primary (one-time-use-only) or a rechargeable battery and where the second component is the main component which contains the processing circuitry.

FIG. 4 depicts one particular application of the present invention wherein the first component 40 may be detachably connected to a second component 36. The components are part of a BTE hearing device which can hang behind a users ear 38. The first component 40 may contain a primary (one-time-use-only) or a rechargeable battery, as well as other components requiring electrical connection to the second component 36. The connections between first component 40 and second component 36 may be exposed to perspiration, resulting in a parallel, high-impedance, low-current shunt which can subsequently cause erosion of the anode 14, as shown previously in FIG. 2B.

Figure 5A:
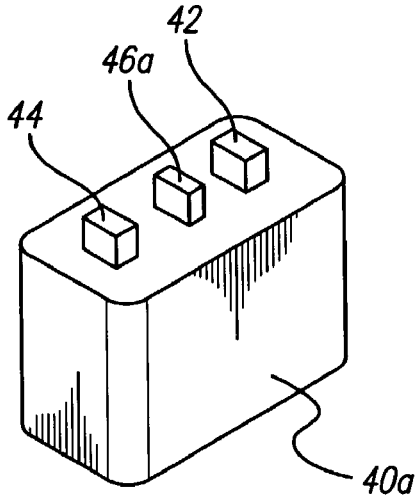
FIG. 5A depicts, in accordance with the present invention, a battery with a sacrificial, anodic plate residing between the two contacts.

FIG. 5A shows, in accordance with the present invention, one embodiment of the device for preventing or reducing anodic corrosion. The sacrificial anode (plate) 46*a* is placed between the negative contact 42 and positive contact 44 all on first component 40*a* of a BTE. Alternatively, the anodic plate 46*a* could be placed on the second component 38, as shown in FIG. 4.

Figure 5B:
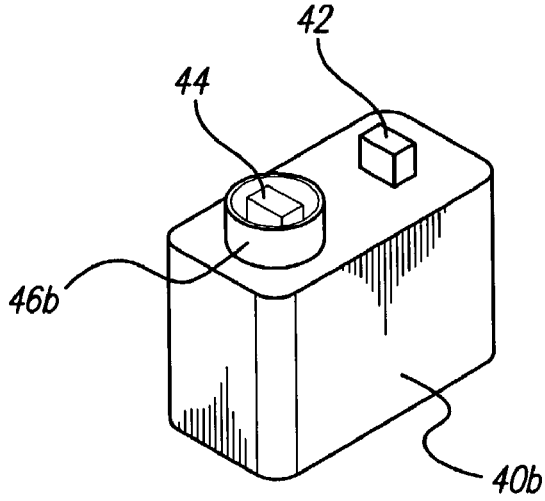
FIG. 5B depicts, in accordance with the present invention, another embodiment of the first component, i.e., a bottom, detachable part of a BTE as shown in FIG. 4, in which a circular, anodic ring encircles the positive contact to shield it from the negative contact.

FIG. 5B shows, in accordance with the present invention, yet another embodiment of the device. In this embodiment the sacrificial anode 46*b* is in the form of a cylindrical ring which completely encircles anode contact 44. This configuration physically shields the electrical field gradient emanating from anode 44 and reduces or prevents an electrical connection between the anode 44 and cathode 42. The electrical path of least resistance is from cathode 42 to the sacrificial anode (cylindrical shield) 46*b*.

Figure 5C:
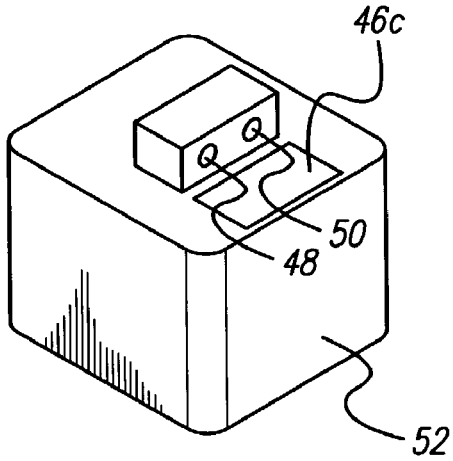
FIG. 5C depicts another embodiment of the corrosion protection device of the present invention in which the sacrificial anodic plate is electrically connected directly to a battery housing.

FIG. 5C shows still another device embodiment, in accordance with the present invention, wherein the device is an aluminum case (or housing) 52 enclosing a primary or rechargeable battery. This battery case 52 can be further contained within a first component 40 of a BTE, as shown in FIG. 4. The cathode contact 50 and anode contact 48, are positioned in parallel within a part of the case. The sacrificial anodic plate 46*c* is placed on the case 52 in close proximity to the anode contact 48 and cathode contact 50. Anodic plate 46*c* has a surface area that is relatively large compared to the anode contact 48. Alternatively, sacrificial anodic ring 46*b* can also be placed to encircle cathode contact 42 to provide anode corrosion protection.

The dimensions for the anodic plate 46*c* shown in FIG. 5C are approximately: between about 0.020 to 0.250 inches long; between about 0.020 to 0.250 inches wide; and between about 0.005 to 0.050 inches thick. More preferably, the dimensions of the sacrificial anodic plate are approximately: about 0.095 inches wide; about 0.160 inches long; and about 0.010 inches thick.

Figure 6A:
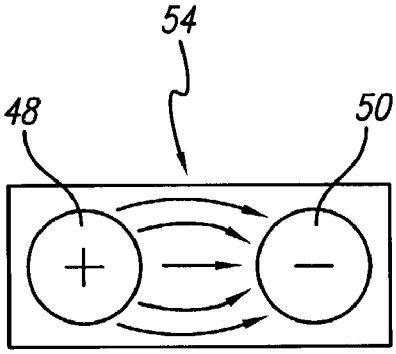
FIG. 6A shows the electrical field gradient between cathodic and anodic contacts as shown in FIG. 5C, but in the absence of a sacrificial, anodic plate.

FIG. 6A shows a representation of an electrical field gradient 54 between the anode and cathode of the device depicted in FIG. 5C, which can occur when the contacts are immersed in a conductive solution and absent a sacrificial anode. The direction of the arrows in FIG. 6A shows a relatively undistorted field 54 emanating from anode 48 and terminating at cathode 50.

Figure 6B:
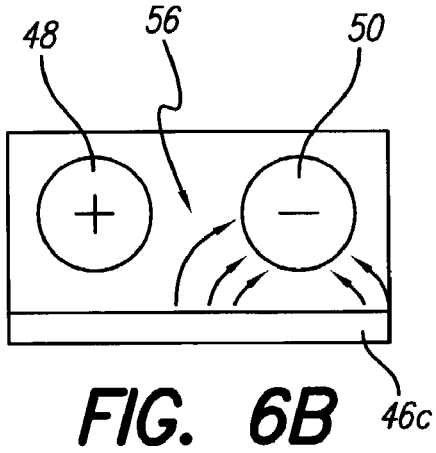
FIG. 6B shows the electrical field gradient between the sacrificial anodic plate and positive contact shown in FIG. 5C.

FIG. 6B shows the electrical field gradient 56 between the sacrificial anodic plate 46*c* and cathode 50 of the device depicted in FIG. 5C when the anodic plate 46*c* has a positive electrical (voltage) potential applied. The electric field gradient 56, which indicates the flow of charges, flows between the sacrificial, anodic plate 46*c* and the cathode 50. As a result, the erosion of material will occur mostly at the anodic plate 46*c* and not the anode 48.

Referring back to FIGS. 5A–C, the devices shown, 40*a* and 40*b*, can represent different embodiments of the first component 40 of a BTE hearing device as shown in FIG. 4. The battery contained in 40*a* or 40*b* may be a rechargeable, lithium-ion battery or a primary battery. The sacrificial anodic plate 46*c* can be made from aluminum and can be welded to an aluminum battery housing 52. The aluminum battery housing may be electrically connected to the anode 48 and to the anodic plate 46*c*. In such a connection configuration, the anodic plate and anode can have the same voltage potential. In cases where the sacrificial anode 46*a*, 46*b* or 46*c* is desired to have a voltage either lower or higher than the anode 44 or 48, a separate power source or other means must be used to apply a different voltage at sacrificial anode 46*a*, 46*b*, and 46*c*. In that case, the sacrificial anode and the anode can be electrically isolated.

The useful life of the sacrificial anode, 46*a*, 46*b*, or 46*c*, will depend on its thickness. A thicker sacrificial anode can be used with a particular device if a longer service life is desired. The sacrificial anode 46*a* is preferably between about 0.005 and 0.250 inches away from the negative contact 42 and preferably closer to the negative contact than the contact-to-contact distance.

While a preferred material for the sacrificial anode is aluminum, other materials such as magnesium, tin, zinc, or nickel may be used. Gold electro-plating is preferred for the positive and negative contacts, but other plating or materials may be used such as nickel, platinum, palladium or rhodium. Preferably, to further reduce the ion removal effects, the negative contact should be made of a material intrinsically more anodic than the material of the positive contact. Thus, for example, the positive (anode) contact may be made from silver, platinum, or palladium, while the negative (cathode) contact may be made from tin, nickel, copper or zinc.

The present invention thus provides an anodic protection device for preventing or reducing galvanic corrosion. A sacrificial anode, having a positive voltage potential less than, equal to, or greater than the potential at the anode, is placed proximate to either the anode or cathode, which placement distorts the electrical field between the positive and negative contacts and causes the sacrificial anode to preferentially corrode, rather than the anode. The specific application of the present invention to a multi-component BTE hearing device is disclosed. In one embodiment a sacrificial anode is welded to the aluminum battery case (housing) such that a depleted battery, including the worn sacrificial anode, can be advantageously discarded together.

The present invention also provides a generalized method for reducing anodic corrosion when two components are electrically connected via a cathodic contact and an anodic contact, when the two contacts are immersed in a conductive solution. In this environment, the anode protection method comprises: (a) attaching a sacrificial anode in close proximity to either the anodic contact or the cathodic contact; and (b) providing a positive potential to the sacrificial anode.

The method may be particularized for use with a BTE hearing device, having a first component and second component, where the two components are electrically connected via a negative (cathodic) contact and a positive (anodic) contact and where the two contacts are immersed in a conductive solution. It will be appreciated, however, that the use of a sacrificial anode is not limited to a BTE device only, but can be employed with other devices where one component is connected to another component by positive and negative electrical contacts.

While the invention herein disclosed has been described by means of specific embodiments and applications thereof, numerous modifications and variations could be made thereto by those skilled in the art without departing from the scope of the invention set forth in the claims.

What is claimed is:

1. An electrical connection between a first component and a second component, said connection resistant to voltage-induced anode corrosion, wherein the first component and second component are detachably connected, and wherein the first component and second component are part of a Behind-the-Ear hearing device, said connection comprising:

a positive contact electrically and mechanically attached to the first component;

a negative contact electrically and mechanically attached to the first component and positioned proximate to but not contacting the positive contact; and a sacrificial anode electrically attached to the first component and positioned proximate to the positive and negative contacts to disrupt the field gradient between the negative and positive contacts, wherein the sacrificial anode has a positive electrical potential, and wherein the sacrificial anode is configured to provide a preferred current flow path between the sacrificial anode and negative contact, via an environment, instead of a shunt path between the positive contact and the negative contact, via the environment.

2. The connection of claim 1, wherein the negative contact includes an exposed surface material and the sacrificial anode is made from a material intrinsically more anodic than the exposed surface material.

3. The connection of claim 2, wherein the sacrificial anode is selected from the group consisting of aluminum, tin, magnesium, zinc, and nickel.

4. The connection of claim 3, wherein the exposed surface material of the positive contact is selected from the group consisting of gold, platinum, palladium, and rhodium.

5. The connection of claim 1, wherein the applied positive potential of the sacrificial anode is equal to the positive contact potential and the sacrificial anode and positive contact are electrically coupled.

6. The connection of claim 1, wherein the first component is a battery.

7. The connection of claim 6, wherein the battery is a rechargeable, lithium-ion battery contained in an aluminum housing, said sacrificial anode is made from aluminum, and said sacrificial anode is electrically coupled to the housing, whereby a depleted battery and worn sacrificial anode may be thrown away together.

8. The connection of claim 1, wherein the sacrificial anode is placed between the positive contact and the negative contact.

9. The connection of claim 1, wherein the sacrificial anode is in the shape of a ring and encircles the positive contact.

10. The connection of claim 1, wherein the sacrificial anode is in the shape of a ring and encircles the negative contact.

11. The connection of claim 1, wherein the distance between the positive contact and the sacrificial anode is less than the distance between the positive contact and the positive contact.

12. A method for reducing or preventing anode corrosion in an electrical connection system between a first and second component, the connection system having a positive (anodic) contact and a negative (cathodic) contact, and wherein the first component comprises a detachable battery of a Behind-the-Ear hearing device, the method comprising:

(a) attaching a sacrificial anode to the first component to disrupt the field gradient between negative and positive contacts, wherein the sacrificial anode is configured to provide a preferred current flow path between the sacrificial anode and negative contact, via an environment; and (b) providing a positive potential to the sacrificial anode.

13. The method of claim 12, wherein the negative contact includes an exposed surface material and the sacrificial anode is made from a material intrinsically more anodic than the exposed surface material.

14. The method of claim 13, wherein the sacrificial anode is selected from the group consisting of aluminum, magnesium, zinc, tin and nickel.

15. The method of claim 14, wherein the exposed surface material of the negative contact is selected from the group consisting of gold, platinum, palladium, and rhodium.

16. The method of claim 12, wherein the applied positive potential of the sacrificial anode is equal to the potential of the positive contact, and the sacrificial anode and positive contact are electrically coupled.

17. The method of claim 12, wherein the battery is a rechargeable, lithium-ion battery contained in an aluminum housing, said sacrificial anode is made from aluminum, and said sacrificial anode is electrically coupled to the housing, whereby a depleted battery and worn sacrificial anode may be thrown away together.

18. The method of claim 12, wherein the sacrificial anode is placed between the positive contact and the negative contact.

19. The method of claim 12, wherein the sacrificial anode is in the shape of a ring and encircles the positive contact.

20. The method of claim 12, wherein the sacrificial anode is in the shape of a ring and encircles the negative contact.

21. The method of claim 12, wherein the distance between the positive contact and the sacrificial anode is less than the distance between the negative contact and the positive contact.

22. An electrical connection between a first component and a second component, said connection resistant to voltage-induced anode corrosion, wherein the first component and second component are detachably connected, and wherein the first component and second component are part of a Behind-the-Ear hearing device, said connection comprising:

a positive contact;

a negative contact;

wherein the positive and negative contacts define a first plane and each contact is mechanically and electrically attached to the first component, and wherein the negative contact is positioned proximate but not contacting the positive contact; and a sacrificial anode is mechanically and electrically attached to at least the first component, wherein the sacrificial anode is configured to reside in a second plane to disrupt the field gradient between the negative and positive contacts, and wherein the sacrificial anode has a positive electrical potential.

23. The connection of claim 22, wherein the sacrificial anode is a plate.

24. The connection of claim 23, wherein the second plane is substantially perpendicular to the first plane.

25. The connection of claim 23, wherein the plate has dimensions between about 0.020 to 0.250 inches long, between about 0.020 to 0.250 inches wide, and between about 0.005 to 0.050 inches thick.

26. The connection of claim 23, wherein the plate has a surface area greater than the surface area of the positive contact.

27. The connection of claim 26, wherein the anodic plate is at about an equal distance from both the negative contact and positive contact.

28. The connection of claim 23, wherein the negative contact includes an exposed surface material and the sacrificial anode is made from a material intrinsically more anodic than the exposed surface material.

29. The connection of claim 28, wherein the sacrificial anode is selected from the group consisting of aluminum, tin, magnesium, zinc, and nickel.

30. The connection of claim 29, wherein the exposed surface material of the positive contact is selected from the group consisting of gold, platinum, palladium, and rhodium.

31. The connection of claim 22, wherein the applied positive potential of the sacrificial anode is equal to the positive contact potential and the sacrificial anode and positive contact are electrically coupled.

32. The connection of claim 22, wherein the first component is a battery.

33. The connection of claim 32, wherein the battery is a rechargeable, lithium-ion battery and said sacrificial anode is electrically coupled to the housing, whereby a depleted battery and worn sacrificial anode may be thrown away together.

* * * * *